US008135586B2

(12) United States Patent
Kim et al.

(10) Patent No.: US 8,135,586 B2
(45) Date of Patent: Mar. 13, 2012

(54) METHOD AND APPARATUS FOR ESTIMATING NOISE BY USING HARMONICS OF VOICE SIGNAL

(75) Inventors: Hyun-Soo Kim, Yongin-si (KR); Hanseok Ko, Seoul (KR); Sung-Joo Ahn, Seoul (KR); Jounghoon Beh, Seoul (KR); Hyun-Jin Yoon, Seoul (KR)

(73) Assignees: Samsung Electronics Co., Ltd (KR); Korea University Industrial & Academic Collaboration Foundation (KR)

( * ) Notice: Subject to any disclaimer, the term of this patent is extended or adjusted under 35 U.S.C. 154(b) by 1027 days.

(21) Appl. No.: 12/053,144

(22) Filed: Mar. 21, 2008

(65) Prior Publication Data

US 2008/0235013 A1 Sep. 25, 2008

(30) Foreign Application Priority Data

Mar. 22, 2007 (KR) ..... 10-2007-0028310

(51) Int. Cl.
*G10L 19/10* (2006.01)

(52) U.S. Cl. ..... 704/220; 704/233; 704/219; 704/225; 704/240; 704/208; 381/94.2; 375/285

(58) Field of Classification Search ..... 704/233, 704/226, 227, 228, 240, 207, 205, 208, 219, 704/225, 220; 381/94.2, 92, 94.1, 58; 375/285
See application file for complete search history.

(56) References Cited

U.S. PATENT DOCUMENTS 5,774,837 A * 6/1998 Yeldener et al. ..... 704/208
5,806,038 A * 9/1998 Huang et al. ..... 704/268
5,963,901 A * 10/1999 Vahatalo et al. ..... 704/233
6,044,341 A * 3/2000 Takahashi ..... 704/226
6,418,408 B1 * 7/2002 Udaya Bhaskar et al. .... 704/219
6,862,567 B1 * 3/2005 Gao ..... 704/228
6,931,373 B1 * 8/2005 Bhaskar et al. ..... 704/230
6,996,523 B1 * 2/2006 Bhaskar et al. ..... 704/222
7,013,269 B1 * 3/2006 Bhaskar et al. ..... 704/219
7,016,837 B2 * 3/2006 Seo et al. ..... 704/233
7,302,065 B2 * 11/2007 Furuta ..... 381/94.3
7,421,377 B2 * 9/2008 Zhang ..... 702/191

(Continued)

FOREIGN PATENT DOCUMENTS

EP 1 059 628 12/2000

(Continued)

OTHER PUBLICATIONS

Rainer Martin: Noise Power Spectral Density Estimation based on Optimal Smoothing and Minimum Statistics, IEEE Transactions on Speech and Audio Processing, Jul. 2001.

(Continued)

*Primary Examiner* — Vijay B Chawan

(74) *Attorney, Agent, or Firm* — The Farrell Law Firm, P.C.

(57) ABSTRACT

Disclosed is a method and an apparatus for estimating noise included in a sound signal during sound signal processing. The method includes estimating harmonics components in a frame of an input sound signal; using the estimated harmonics components, computing a Voice Presence Probability (VPP) on the frame of the input sound signal; determining a weight of an equation necessary to estimate a noise spectrum, depending on the computed VPP; and using the determined weight and the equation necessary to estimate a noise spectrum, estimating the noise spectrum, and updating the noise spectrum.

9 Claims, 5 Drawing Sheets

U.S. PATENT DOCUMENTS

| | | | | |
|---|---|---|---|---|
| 7,783,481 | B2 * | 8/2010 | Endo et al. | 704/226 |
| 2002/0150265 | A1 * | 10/2002 | Matsuzawa et al. | 381/94.2 |
| 2003/0097260 | A1 * | 5/2003 | Griffin et al. | 704/230 |
| 2003/0220787 | A1 * | 11/2003 | Svensson et al. | 704/207 |
| 2004/0002856 | A1 * | 1/2004 | Bhaskar et al. | 704/219 |
| 2005/0154583 | A1 * | 7/2005 | Naka et al. | 704/217 |
| 2007/0027681 | A1 | 2/2007 | Kim | |

FOREIGN PATENT DOCUMENTS

| | | |
|---|---|---|
| KR | 1020070015811 | 2/2007 |

OTHER PUBLICATIONS

Israel Cohen et al., "Speech Enhancement for non-stationary Noise Environments", Signal Processing 81, Jun. 2001.

* cited by examiner

METHOD AND APPARATUS FOR ESTIMATING NOISE BY USING HARMONICS OF VOICE SIGNAL

PRIORITY

This application claims the benefit under 35 U.S.C. §119 (a) of an application entitled "Method and Apparatus for Estimating Noise by Using Harmonics of Voice Signal" filed in the Korean Industrial Property Office on Mar. 22, 2007 and assigned Serial No. 2007-0028310, the contents of which are incorporated herein by reference.

BACKGROUND OF THE INVENTION

1. Field of the Invention

The present invention relates to sound signal processing, and, more particularly, to a method and an apparatus for estimating noise included in a sound signal.

2. Description of the Related Art

In sound signal processing for voice communication or for voice recognition that requires voice enhancement, it is important to estimate and remove noise included in a voice signal. Accordingly, schemes for estimating noise have been being proposed and used. For example, to estimate noise, one scheme first estimates the noise during a definite time interval, i.e. a period, in which a voice does not exist before the voice is input, and once the voice is input, a signal to reduce the estimated noise is applied. In another scheme, a voice is distinguished from a non-voice by using Voice Activity Detection (VAD), and then noise is estimated during a non-voice period. There is also a minimum statistics-based noise estimation scheme in which, based on characteristics of a voice spectral energy in a voice period being larger than spectral energy of noise and of a pronunciation period of a voice word corresponds to 0.7 to 1.3 seconds, values representing minimum energy in a given period are estimated to be noise. In a still further scheme, an approximate determination is made of the probability regarding whether a voice exists, to estimate noise during a period in which Voice Presence Probability (VPP) is large, whereas noise is not estimated during a period in which the VPP is small.

However, the above conventional noise estimation schemes have drawbacks in that they cannot detect changes of non-stationary noise, to reflect the changes in noise estimation. For example, inaccurate noise such as ambient audio sound that is abruptly generated in real life, or noise including a sound generated when a door is closed, a sound of footsteps, etc., having a short time duration but as also having a similarly large magnitude of energy as that of voice energy, cannot be effectively estimated. Hence, problems arise in that inaccurate noise estimation causes a problem of residual noise. Residual noise causes inconvenience of hearing to a user in voice communication or malfunction of a voice recognizing device, which degrades the performance of a voice recognizing product.

The reason conventional noise estimation schemes have the above problems is that when a scheme of processing a subsequent voice signal with reference to a result in a voice period previously processed, noise that is not the same as previous noise in a relevant period may exist, and when a scheme of estimating noise during only a relevant period with approximate prediction of a period in which noise exists, there is a limit for accurately estimating a period in which noise exists. Also, since a scheme for distinguishing between a voice and a non-voice by using a difference between the magnitudes of energy of respective signals or Signal-to-Noise Ratio (SNR), i.e. when a scheme for recognizing a period as a voice period if the value such as a difference between the magnitudes of energy of respective signals or Signal-to-Noise Ratio (SNR) is large and for regarding a period as a non-voice period if the value is small, if ambient noise having energy whose magnitude is similar to that of energy of a voice is input, noise estimation is not implemented, and, accordingly, a noise spectrum is not updated.

SUMMARY OF THE INVENTION

Accordingly, the present invention has been made to solve the above-stated problems occurring in conventional methods, and the present invention provides a method and an apparatus for estimating non-stationary noise in voice signal processing, and for eliminating the estimated non-stationary noise.

Also, the present invention provides a method and an apparatus for estimating noise having energy whose magnitude is similar to that of energy of a voice, and for removing the estimated noise.

Furthermore, the present invention provides a method and an apparatus for effectively estimating noise, and for removing the estimated noise.

In accordance with an aspect of the present invention, there is provided a method for estimating noise by using harmonics of a voice signal, including estimating harmonics components in a frame of an input sound signal; using the estimated harmonics components, computing a Voice Presence Probability (VPP) on the frame of the input sound signal; determining a weight of an equation necessary to estimate a noise spectrum as defined below, depending on the computed VPP; and using the determined weight and the equation necessary to estimate a noise spectrum, estimating the noise spectrum, and updating the noise spectrum, $$N(k,t)=\alpha(k,t)N(k,t-1)+(1-\alpha(k,t))Y(k,t),$$

where N(k, t) represents a noise spectrum, Y(k, t) represents a spectrum of an input signal, an index k represents a frequency index, an index t represents a frame index, and $\alpha(k, t)$ represents a weight.

In accordance with another aspect of the present invention, there is provided an apparatus for estimating noise by using harmonics of a voice signal, including a harmonics estimation unit for estimating harmonics components in a frame of an input sound signal, and for outputting the estimated harmonics components; a voice estimation unit for using the estimated harmonics components, computing a Voice Presence Probability (VPP) on the frame of the input sound signal, and outputting the computed VPP; a weight determination unit for determining a weight of an equation necessary to estimate a noise spectrum as defined below, depending on the computed VPP, and for outputting the determined weight; and a noise spectrum update unit for using the determined weight and the equation necessary to estimate a noise spectrum, estimating the noise spectrum, and updating the noise spectrum, $$N(k,t)=\alpha(k,t)N(k,t-1)+(1-\alpha(k,t))Y(k,t),$$

where N(k, t) represents a noise spectrum, Y(k, t) represents a spectrum of an input signal, an index k represents a frequency index, an index t represents a frame index, and $\alpha(k, t)$ represents a weight.

BRIEF DESCRIPTION OF THE DRAWINGS

The above and other exemplary features, aspects, and advantages of the present invention will be more apparent from the following detailed description taken in conjunction with the accompanying drawings, in which.

DETAILED DESCRIPTION OF THE PREFERRED EMBODIMENTS

Hereinafter, exemplary embodiments of the present invention will be described in detail with reference to the accompanying drawings. The next description includes particulars, such as specific configuration elements, which are only presented in support of more comprehensive understanding of the present invention, and it will be obvious to those of ordinary skill in the art that prescribed changes in form and modifications may be made to the particulars in the scope of the present invention. Further, in the following description of the present invention, a detailed description of known unctions and configurations incorporated herein is omitted to avoid making the subject matter of the present invention unclear.

For a human being to pronounce a vocal sound, vibrations of the vocal chords must be generated, and the vibrations appear in the form of harmonics in the frequency domain. Also, components of the harmonics have characteristics such that most properties thereof remain, even in a noisy environment. In the present invention, by using vocal sounds and the characteristics of harmonics, depending on how many harmonics components exist in a sound signal, a suitable noise spectrum is estimated, and the value of the noise spectrum is updated. At this time, Equation (1) is used to estimate a noise spectrum.

$$N(k,t)=\alpha(k,t)N(k,t-1)+(1-\alpha(k,t))Y(k,t) \quad (1)$$

Herein, N(k, t) represents the noise spectrum, Y(k, t) represents a spectrum of an input signal, k represents a frequency index, and t represents a frame index. The above Equation (1) corresponds to an equation used to estimate a noise spectrum in a Minima Controlled Recursive Averaging (MCRA) noise estimation scheme. In the present invention, based on Voice Presence Probability (VPP), which is estimated by using harmonics detected in an input sound signal, the value of a weight $\alpha(k, t)$ of the above Equation (1) is adjusted, and then a noise spectrum is estimated.

Figure 1:
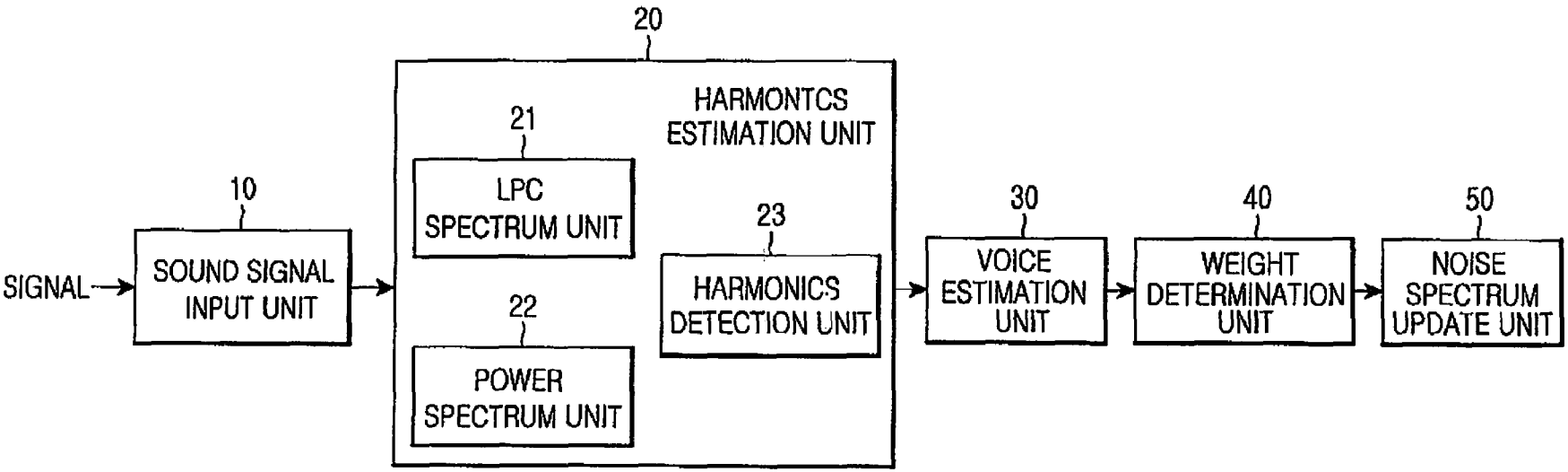
FIG. 1 is a block diagram illustrating the configuration of an apparatus for estimating noise according to an embodiment of the present invention.

An apparatus for estimating noise to which the present invention in this manner is applied is described as follows with reference to FIG. 1. As illustrated in FIG. 1, the apparatus for estimating noise (i.e. the noise estimation apparatus) includes a sound signal input unit 10, a harmonics estimation unit 20, a voice estimation unit 30, a weight determination unit 40 and a noise spectrum update unit 50.

By using a Hanning window having a predetermined length, the sound signal input unit 10 divides an input sound signal into frames. For instance, by using the Hanning window 32 milliseconds in length, a sound signal can be divided into frames, and at this time, a moving period of the Hanning window can be set to 16 milliseconds. The sound signal divided into frames by the sound signal input unit 10 is output to the harmonics estimation unit 20.

The harmonics estimation unit 20 extracts harmonics components from an input sound signal by the frame, and outputs the extracted harmonics components to the voice estimation unit 30. As indicated above, to pronounce a vocal sound, vibrations of the vocal chords are generated and the vibrations appear in the form of harmonics in the frequency domain. In order to find the harmonics, components related to a shape of a vocal passage that determines the type of vocal sound a human being utters must be removed for vocal sounds, corresponding to a vibration signal of the vocal cords and the shape of the vocal passage, the vocal sound is represented as a convolution of impulse responses, and the convolution of impulse responses is readily represented in the form of multiplication in the frequency domain. So that the harmonics estimation unit 20 can estimate harmonics in an input sound signal based on characteristics of the vocal sounds, according to an embodiment of the present invention, the harmonics estimation unit 20 includes an LPC spectrum unit 21, a power spectrum unit 22, and a harmonics detection unit 23. The LPC spectrum unit 21 converts a sound signal by the frame provided from the sound signal input unit 10 into an LPC spectrum, and outputs the LPC spectrum to the harmonics detection unit 23.

Figure 3A:
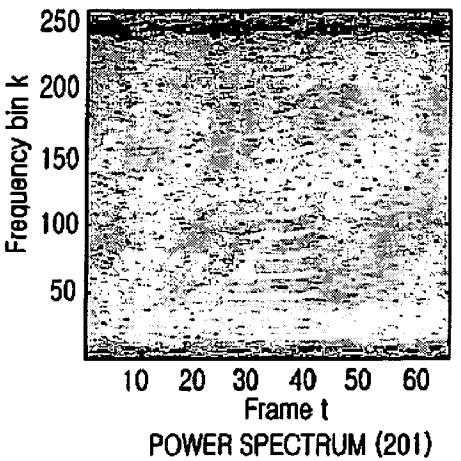
FIGS. 3A, 3B and 3C show examples of a power spectrum, a Linear Prediction Coefficients (LPC) spectrum, and a harmonics spectrogram according to an embodiment of the present invention, respectively.
Figure 3B:
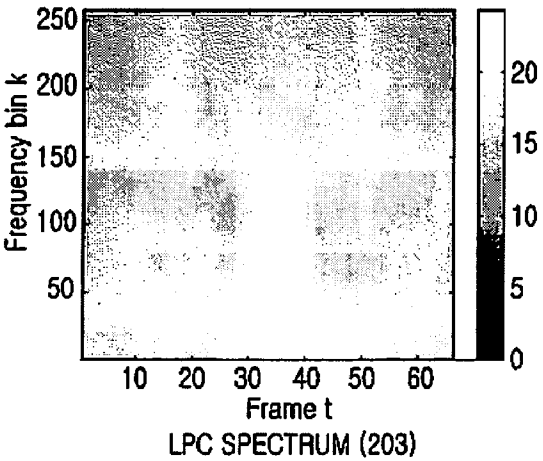
Figure 3C:
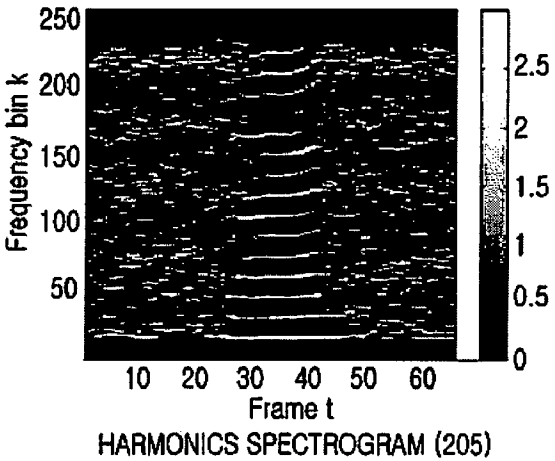

The power spectrum unit 22 converts a sound signal by the frame provided from the sound signal input unit 10 into a power spectrum, and outputs the power spectrum to the harmonics detection unit 23. By using the input LPC spectrum and the input power spectrum, the harmonics detection unit 23 detects harmonics components in a relevant frame of a sound signal, and outputs the detected harmonics components to the voice estimation unit 30. Namely, the harmonics detection unit 23 divides the LPC spectrum into the power spectrums, and then detect harmonics components. Respective examples of such spectrums are shown in FIGS. 3A-C, which show a power spectrum, a Linear Prediction Coefficients (LPC) spectrum, and a harmonics spectrogram according to an embodiment of the present invention, respectively. Referring to the harmonics spectrogram of FIG. 3C, it can be appreciated that when a sound signal is represented in the form of a spectrum, harmonics appear in the shape of stripes having definite respective lengths, and a relatively large part of the shape remains even in a noisy environment. However, examination of the harmonics spectrogram reveals that noise around a voice causes a part (i.e., a part in white remaining in other parts except for a part representing a voice), which does not represent harmonics but has the values on the spectrogram, to exist. To remove the white part, the harmonics detection unit 23 enables a mask having a suitable value. The harmonics estimation unit 20 that detects the harmonics through this process outputs the detected harmonics to the voice estimation unit 30. The voice estimation unit 30 uses input harmonics components and estimates the VPP. According to an embodiment of the present invention, the voice estimation unit 30 computes Local Voice Presence Probability (LVPP) and Global Voice Presence Probability (GVPP), and computes VPP, which is then provided to the weight determination unit 40.

Based on the input VPP, the weight determination unit 40 determines the weight $\alpha(k, t)$ In Equation (1). As in the harmonics spectrogram of FIG. 3C, harmonics components appear in the shape of stripes. Since a part having significant values besides another part representing the harmonics corresponds to an unusual part, when a noise spectrum is updated using Equation (1), the value of the weight α(k, t) in Equation (1) must be small, and in relation to the part representing the harmonics, the value of the weight α(k, t) approaches '1,' so that a voice spectrum must not be used to update the noise spectrum. Accordingly, the value of a voice potential weight α(k, t) depending on the values of the GVPP and LVPP is determined with a point of reference defined by TABLE 1. In TABLE 1 below, the LVPP has the values between '0' and '1,' by normalizing the result values of the harmonics spectrogram of FIG. 3C. Also, the result values of the harmonics spectrogram 205 are added on a frame-by-frame basis, and are then normalized with the consequence that the GVPP has values between '0' and '1.'

TABLE 1

| LVPP(k, t) | GVPP(k, t) | the possibility to be a voice | α(k, t) |
|---|---|---|---|
| large | large | very large | 1 |
| large | small | large | the value approaching 1 |
| small | large | very small | 0 |
| small | small | small | the value approaching 0 |

In the above table 1, the values of the GVPP and LVPP 1 can be determined by a reference value.

Then, by using Equation (2) defined below, a weight α(k, t) is computed.

$$\alpha(k, t) = 1 - \frac{0.5}{1 + \exp(-20 \times (LVPP(k, t) + 0.5) \times (0.3 - GVPP(k, t)))} \quad (2)$$

Figure 4:
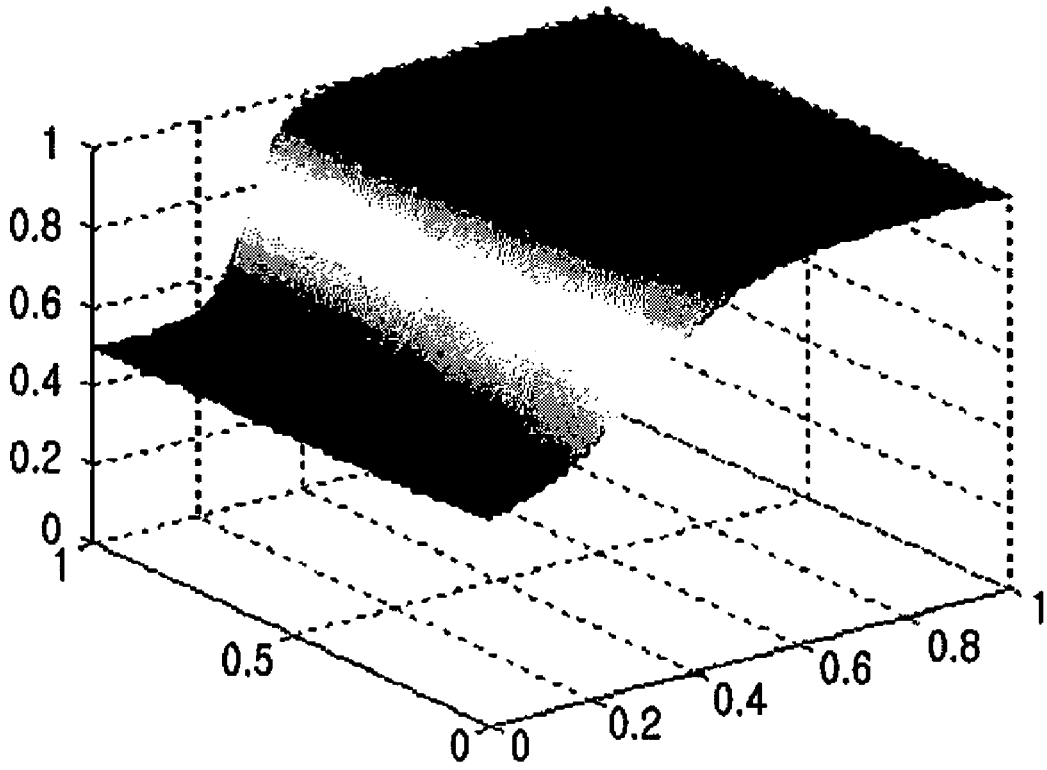
FIG. 4 is a graph of values of weights of an equation necessary to estimate a noise spectrum according to an embodiment of the present invention.

Equation (2) can be represented as a graph as illustrated in FIG. 4, which is a graph of values of weights of an equation necessary to estimate a noise spectrum according to an embodiment of the present invention.

The weight determination unit 40 outputs a determined weight to the noise spectrum update unit 50. Then, by using an input weight and Equation (1), the noise spectrum update unit 50 estimates a noise spectrum, and updates the value of a noise spectrum estimated by up to an immediately previous frame. An operation process of the above noise estimation apparatus is illustrated in FIG. 2.

Figure 2:
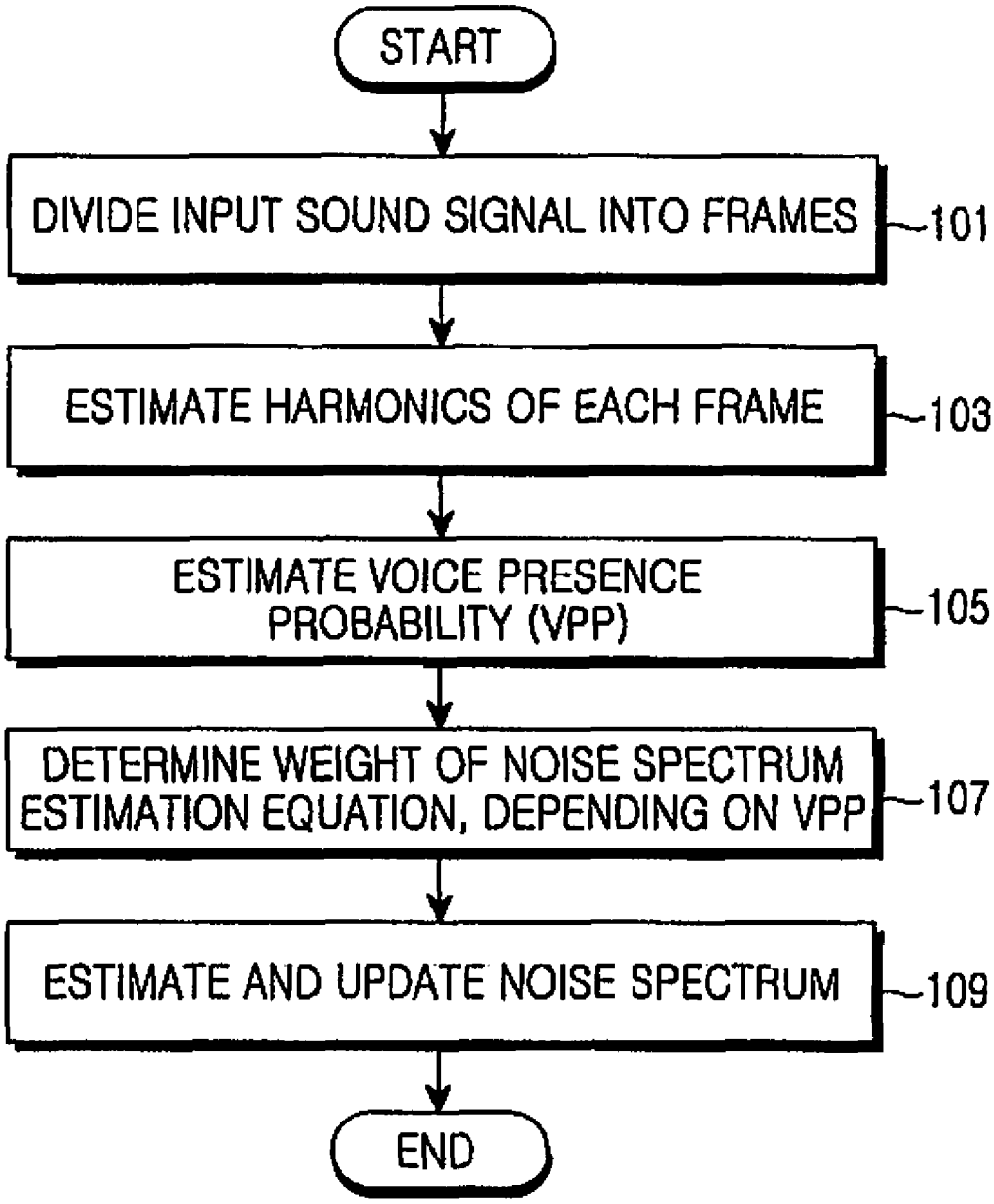
FIG. 2 is a flowchart illustrating a process for estimating noise according to an embodiment of the present invention.

As illustrated in FIG. 2, the noise estimation apparatus divides an input sound signal into frames in step 101, and proceeds to step 103. In step 103, the noise estimation apparatus estimates harmonics of each frame, and proceeds to step 105. In step 105, the noise estimation apparatus uses the estimated harmonics to estimate VPP, and proceeds to step 107 to determine a weight of Equation (1) on the basis of the estimated VPP. In step 109, the noise estimation apparatus uses the determined weight to estimate a noise spectrum, updates a noise spectrum, and completes an operation process. The noise spectrum that has been estimated through the above process is used to remove the noise from the input sound signal.

Figure 5A:
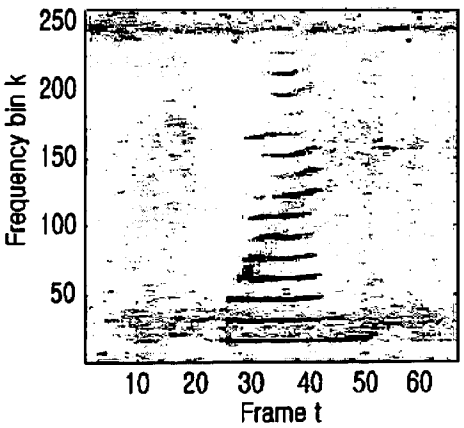
FIGS. 5A-5D show examples of frequency diagrams obtained from a noise spectrum estimations implemented in a prior scheme and according to an embodiment of the present invention, respectively.
Figure 5B:
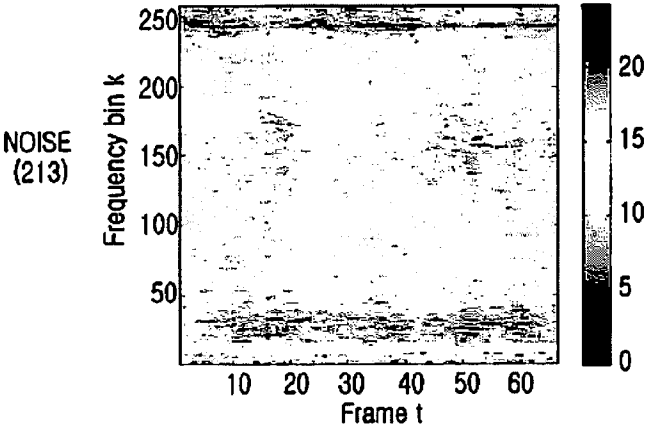
Figure 5C:
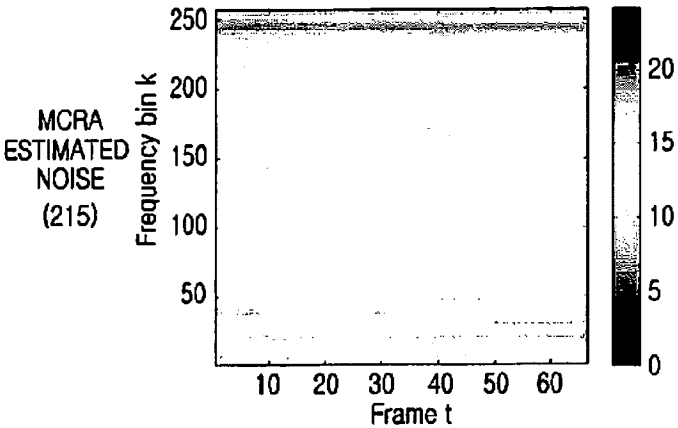
Figure 5D:
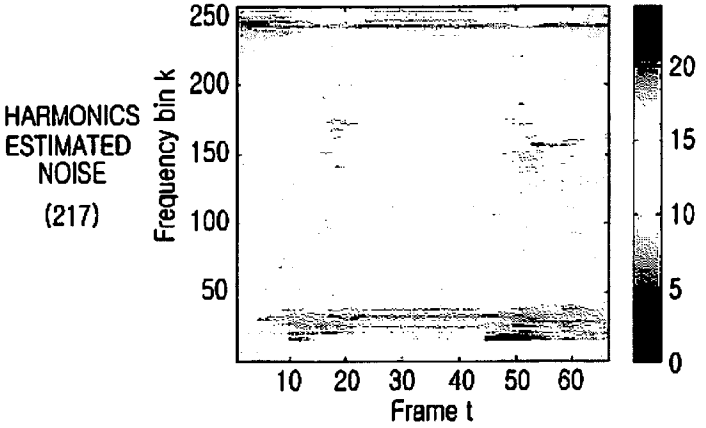

As described, in the present invention the harmonics components of the sound signal are used to compute the probability that a voice signal will be present in the sound signal, the weight of Equation (1) is determined based on the computed probability to estimate the noise spectrum, and therefore the weights have a more extensive range than in conventional systems. Namely, it can be understood that in a conventional Minima Controlled Recursive Averaging (MCRA) scheme, the range of a weight α(k, t) corresponds to $0.95 \leqq \alpha(k,t) \leqq 1$, whereas according to the present invention, the range of a weight α(k, t) corresponds to $0.5 \leqq \alpha(k, t) \leqq 1$. Accordingly, a noise spectrum estimated according to the present invention is compared with a noise spectrum obtained in the conventional MCRA scheme as illustrated in FIGS. 5A-D, which are views illustrating examples of diagrams drawn based on a noise spectrum estimations implemented in a prior scheme and according to an embodiment of the present invention. With reference to FIG. 5C, when noise 213 included in a noisy signal 211 is as illustrated in FIG. 5A, it can be appreciated that a noise spectrum 217 (FIG. 5D) estimated by using the harmonics components according to the present invention is more similar to original noise 213 (FIG. 5B) than a noise spectrum 215 (FIG. 5C) estimated in the MCRA scheme. Also, if non-stationary noise having as large a magnitude as voice energy is generated, a conventional scheme in which the SNR has been used as a factor to determine a weight regards noise as a voice in processing the noise, whereas harmonics are used as a factor to determine a weight in the present invention, thereby estimating the non-stationary noise and thereby updating a noise spectrum.

The merits and effects of exemplary embodiments, as disclosed in the present invention, and as so configured to operate above, are described as follows.

As described above, according to the present invention, harmonics components of a sound signal are used to compute probability that a voice signal will be present in a sound signal, a weight of a noise spectrum estimation equation is determined based on the computed probability to estimate a noise spectrum, and therefore weights can have a more extensive range than in conventional systems. Also, as harmonics are used as a factor to determine the weight, a noise spectrum is updated using an estimation of non-stationary noise.

While the invention has been shown and described with reference to certain exemplary embodiments thereof, it will be understood by those skilled in the art that various changes in form and details may be made therein without departing from the spirit and scope of the invention. Therefore, the spirit and scope of the present invention must be defined not by described embodiments thereof but by the appended claims and equivalents of the appended claims.

What is claimed is:

1. A method for estimating noise by using harmonics of a voice signal, the method comprising the steps of:

(a) estimating harmonic components in a frame of an input sound signal;

(b) using the estimated harmonic components, computing a Voice Presence Probability (VPP) on the frame of the input sound signal;

(c) determining a weight of an equation necessary to estimate a noise spectrum, depending on the computed VPP utilizing:

$$N(k,t)=\alpha(k,t)N(k,t-1)+(1-\alpha(k,t))Y(k,t),$$

where N(k, t) represents the noise spectrum, Y(k, t) represents a spectrum of the input sound signal, k represents a frequency index, t represents a frame index and α(k, t) represents the weight; and (d) estimating the noise spectrum by using the determined weight and the equation, and updating the noise spectrum.

2. The method as claimed in claim 1, wherein, in step (c), the weight is determined to have a value approximating '1' if the VPP is larger than a specific represent value, and the weight is determined to have a value approximating '0' if the VPP is smaller then the specific represent value.

3. The method as claimed in claim 2, wherein, in step (b), the harmonics components are used to compute a Local Voice Presence Probability (LVPP) and a Global Voice Presence Probability (GVPP), thereby computing the VPP.

4. The method as claimed in claim 3, wherein the weight is determined by:

$$\alpha(k, t) = 1 - \frac{0.5}{1 + \exp(-20 \times (LVPP(k, t) + 0.5) \times (0.3 - GVPP(k, t)))}.$$

5. An apparatus for estimating noise by using harmonics of a voice signal, the apparatus comprising:

a harmonics estimation unit for estimating harmonic components in a frame of an input sound signal, and for outputting the estimated harmonic components;

a voice estimation unit for using the estimated harmonic components, computing a Voice Presence Probability (VPP) on the frame of the input sound signal, and outputting the computed VPP;

a weight determination unit for determining a weight of an equation necessary to estimate a noise spectrum, depending on the computed VPP, and for outputting the determined weight utilizing:

$$N(k,t)=\alpha(k,t)N(k,t-1)+(1-\alpha(k,t))Y(k,t),$$

where N(k, t) represents the noise spectrum, Y(k, t) represents a spectrum of the input sound signal, k represents a frequency index, t represents a frame index and $\alpha(k, t)$ represents the weight; and a noise spectrum update unit for estimating the noise spectrum by using the determined weight and the equation, and updating the noise spectrum.

6. The apparatus as claimed in claim 5, further comprising a sound signal input unit for dividing the input sound signal into frames respectively having predetermined lengths and then outputting the frames.

7. The apparatus as claimed in claim 6, wherein the weight determination unit determines the weight to have a value approximating '1' if the VPP is larger than a specific represent value, and determines the weight to have a value approximating '0' if the VPP is smaller then the specific represent value.

8. The apparatus as claimed in claim 7, wherein the voice estimation unit uses the harmonics components to compute a Local Voice Presence Probability (LVPP) and a Global Voice Presence Probability (GVPP), and thereby computes the VPP.

9. The apparatus as claimed in claim 8, wherein the weight determination unit determines the weight using:

$$\alpha(k, t) = 1 - \frac{0.5}{1 + \exp(-20 \times (LVPP(k, t) + 0.5) \times (0.3 - GVPP(k, t)))}.$$

* * * * *